US011692729B2

(12) United States Patent
Longenecker et al.

(10) Patent No.: US 11,692,729 B2
(45) Date of Patent: Jul. 4, 2023

(54) SINGLE-PACKAGE AIR CONDITIONER AND METHODS OF OPERATION

(71) Applicant: Haier US Appliance Solutions, Inc., Wilmington, DE (US)

(72) Inventors: Joshua Duane Longenecker, Louisville, KY (US); Craig Benjamin Williams, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 230 days.

(21) Appl. No.: 16/918,546

(22) Filed: Jul. 1, 2020

(65) Prior Publication Data

US 2022/0003448 A1 Jan. 6, 2022

(51) Int. Cl.

| | |
|---|---|
| ***F24F 11/64*** | (2018.01) |
| ***F24F 1/031*** | (2019.01) |
| ***F24F 11/86*** | (2018.01) |
| ***F24F 11/56*** | (2018.01) |
| ***F24F 1/0358*** | (2019.01) |
| ***F24F 120/10*** | (2018.01) |

(52) U.S. Cl.

CPC ..... *F24F 11/64* (2018.01); *F24F 1/031* (2019.02); *F24F 1/0358* (2019.02); *F24F 11/56* (2018.01); *F24F 11/86* (2018.01); *F24F 2120/10* (2018.01)

(58) Field of Classification Search

CPC .. F24F 11/64; F24F 11/86; F24F 11/56; F24F 1/0358; F24F 1/031; F24F 2120/10; F24F 2120/12; F24F 2120/14

See application file for complete search history.

(56) References Cited

U.S. PATENT DOCUMENTS

| | | | | |
|---|---|---|---|---|
| 5,058,388 | A * | 10/1991 | Shaw | F24F 3/044 62/93 |
| 6,986,386 | B2 * | 1/2006 | Sekhar | F24F 3/0442 165/252 |
| 8,793,021 | B2 | 7/2014 | Besore | |
| 9,031,706 | B2 * | 5/2015 | Kim | F24F 11/62 700/297 |
| 2003/0160103 | A1 * | 8/2003 | Guo | F24F 11/63 236/47 |
| 2010/0070091 | A1 * | 3/2010 | Watson | G06Q 50/06 700/278 |

(Continued)

*Primary Examiner* — Schyler S Sanks

(74) *Attorney, Agent, or Firm* — Dority & Manning, P.A.

(57) ABSTRACT

A single-package air conditioner unit, as provided herein, may include a cabinet, an outdoor heat exchanger, an indoor heat exchanger, a compressor, and a controller. The cabinet may define an outdoor portion and an indoor portion. The outdoor heat exchanger may be disposed in the outdoor portion. The indoor heat exchanger may be disposed in the indoor portion. The compressor may be in fluid communication with the outdoor heat exchanger and the indoor heat exchanger to circulate a refrigerant therebetween. The controller may be in operative communication with the compressor. The controller may be configured to initiate a conditioning operation. The conditioning operation may include receiving a demand response signal corresponding to electric power access, determining occupancy of an indoor environment, and initiating a responsive conditioning cycle in response to receiving the demand response signal, the responsive conditioning cycle being based on the determined occupancy.

20 Claims, 6 Drawing Sheets

(56) References Cited

U.S. PATENT DOCUMENTS

| | | | | |
|---|---|---|---|---|
| 2016/0061467 | A1* | 3/2016 | Billman | F24F 11/70 62/159 |
| 2018/0100661 | A1 | 4/2018 | Zhang | |

* cited by examiner

SINGLE-PACKAGE AIR CONDITIONER AND METHODS OF OPERATION

FIELD OF THE INVENTION

The present subject matter relates generally to single-package air conditioner units, including methods of operating such units with a remote temperature sensor.

BACKGROUND OF THE INVENTION

Air conditioner units are conventionally used to adjust the temperature within structures such as dwellings and office buildings. In particular, one-unit type or single-package room air conditioner units (i.e., non-split units), such as window units, single-package vertical units (SPVU), vertical packaged air conditioners (VPAC), or package terminal air conditioners (PTAC) may be used to adjust the temperature in, for example, a single room or group of rooms of a structure. Such units are especially common in hotels, rental apartments, and assisted-living facilities in which a large number of occupants live within the same building.

A typical one-unit type air conditioner or air conditioning appliance includes an indoor portion and an outdoor portion. The indoor portion generally communicates (e.g., exchanges air) with the area within a building or indoor environment, and the outdoor portion generally communicates (e.g., exchanges air) with the area outside a building. Accordingly, the air conditioner unit generally extends through, for example, a wall of the structure. Generally, a fan may be operable to rotate to motivate air through the indoor portion. Another fan may be operable to rotate to motivate air through the outdoor portion. A sealed cooling system including a compressor is generally housed within the air conditioner unit to treat (e.g., cool or heat) air as it is circulated through, for example, the indoor portion of the air conditioner unit. One or more control boards are typically provided to direct the operation of various elements of the particular air conditioner unit.

One of the challenges that exist, especially for single-package air conditioner units, is identifying the appropriate operating cycle or state for a particular unit. For example, if a particular unit is merely one of multiple units installed within a given building (e.g., as would be the case for a multiple-occupancy building or hotel), it may be difficult to manually adjust each unit. In turn, a particular air conditioner unit may operate to provide excessive heat or cooling to a corresponding room or indoor environment, even when power costs are particularly high or a room is unoccupied. This can be inefficient and costly to building owners or unit owners. Previously, attempts have been made to control particular air conditioner units using a connected external thermostats. Nonetheless, such systems are generally unable to provide significant variability to a unit's operation. For instance, external thermostats are generally manufactured separately from air conditioner units and must be configured to work multiple air conditioner unit models made by various manufacturers.

Accordingly, improved air conditioner units and associated control systems for selectively adjusting operation (e.g., based on occupancy or power costs) would be useful. More specifically, an in-unit control system for a packaged terminal air conditioner unit that adjusts operation based on power costs or room occupancy status would be particularly beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating single-package air conditioner unit is provided. The method may include receiving a demand response signal corresponding to electric power access. The method may further include determining occupancy of an indoor environment within which the single-package air conditioner unit is mounted. The method may still further include initiating a responsive conditioning cycle in response to receiving the demand response signal, the responsive conditioning cycle being based on the determined occupancy.

In another exemplary aspect of the present disclosure, a single-package air conditioner unit is provided. The single-package air conditioner unit may include a cabinet, an outdoor heat exchanger, an indoor heat exchanger, a compressor, and a controller. The cabinet may define an outdoor portion and an indoor portion. The outdoor heat exchanger may be disposed in the outdoor portion and include an outdoor heat exchanger. The indoor heat exchanger may be disposed in the indoor portion and include an indoor heat exchanger. The compressor may be in fluid communication with the outdoor heat exchanger and the indoor heat exchanger to circulate a refrigerant between the outdoor heat exchanger and the indoor heat exchanger. The controller may be in operative communication with the compressor. The controller may be configured to initiate a conditioning operation. The conditioning operation may include receiving a demand response signal corresponding to electric power access, determining occupancy of an indoor environment, and initiating a responsive conditioning cycle in response to receiving the demand response signal, the responsive conditioning cycle being based on the determined occupancy.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
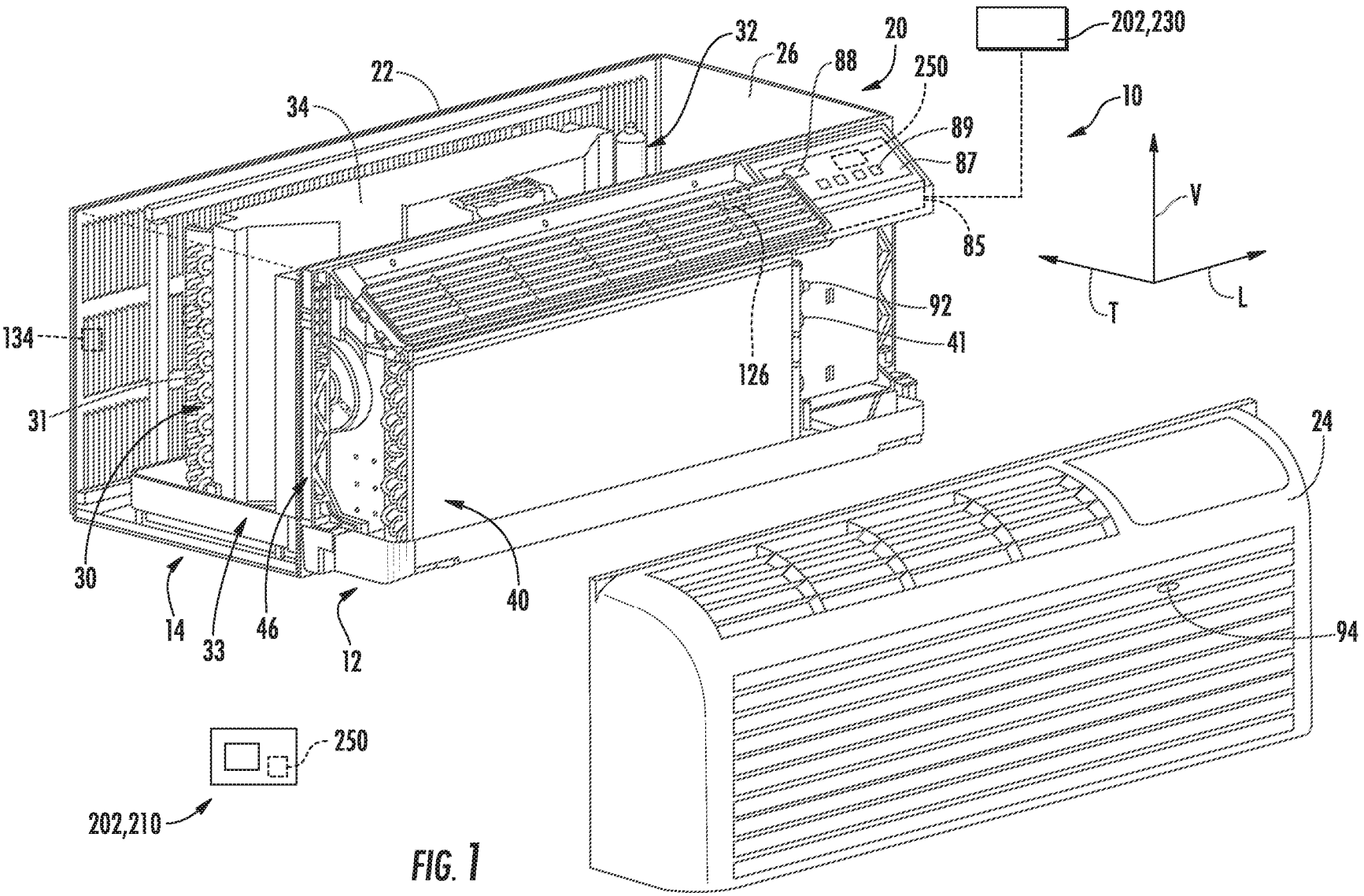
FIG. 1 provides a perspective view of an air conditioner unit, with a room front exploded from a remainder of the air conditioner unit for illustrative purposes, in accordance with exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Referring now to the figures, in FIGS. 1 through 5, an air conditioner 10 according to various exemplary embodiments is provided. The air conditioner 10 is generally a one-unit type air conditioner, also conventionally referred to as a room air conditioner or package terminal air conditioner unit (PTAC). The air conditioner 10 includes an indoor portion 12 and an outdoor portion 14, and defines a vertical direction V, a lateral direction L, and a transverse direction T. Each direction V, L, T is perpendicular to each other, such that an orthogonal coordinate system is generally defined.

Although described in the context of a PTAC, an air conditioner unit as disclosed herein may be provided as a window unit, single-package vertical unit (SPVU), vertical packaged air conditioner (VPAC), or any other suitable single-package air conditioner. The air conditioner 10 is intended only as an exemplary unit and does not otherwise limit the scope of the present disclosure. Thus, it is understood that the present disclosure may be equally applicable to other types of air conditioner units.

Generally, a cabinet 20 of the air conditioner 10 contains various other components of the air conditioner 10. Cabinet 20 may include, for example, a rear grill 22 and a room front 24 that may be spaced apart along the transverse direction T by a wall sleeve 26. The rear grill 22 may be part of the outdoor portion 14, while the room front 24 is part of the indoor portion 12. Components of the outdoor portion 14, such as an outdoor heat exchanger 30, outdoor fan 33 (FIG. 5), and compressor 32 may be housed within the wall sleeve 26. A casing 34 may additionally enclose the outdoor fan 33, as shown.

Figure 2:
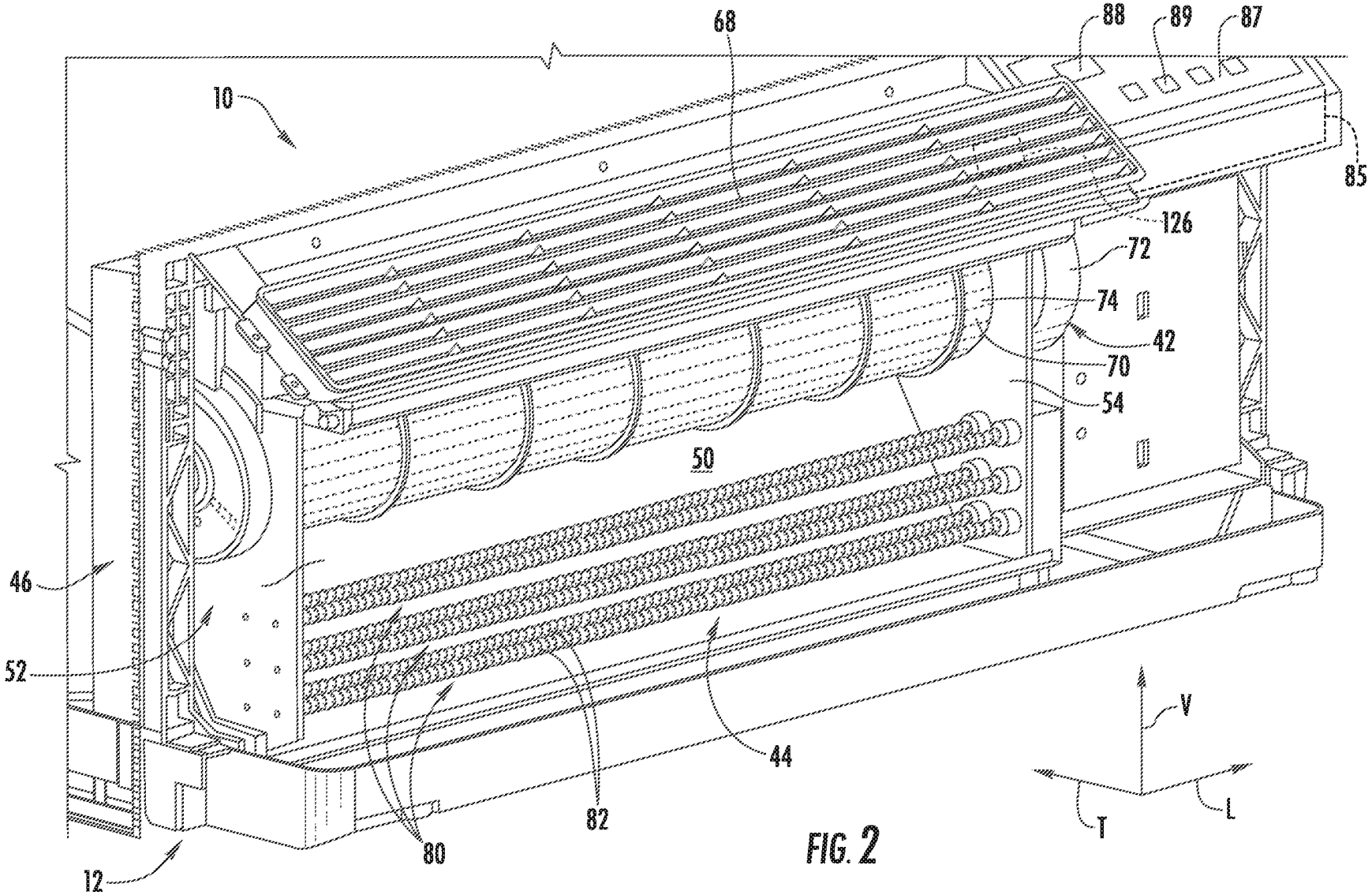
FIG. 2 is a perspective view of components of an indoor portion of an air conditioner unit in accordance with exemplary embodiments of the present disclosure.
Figure 3:
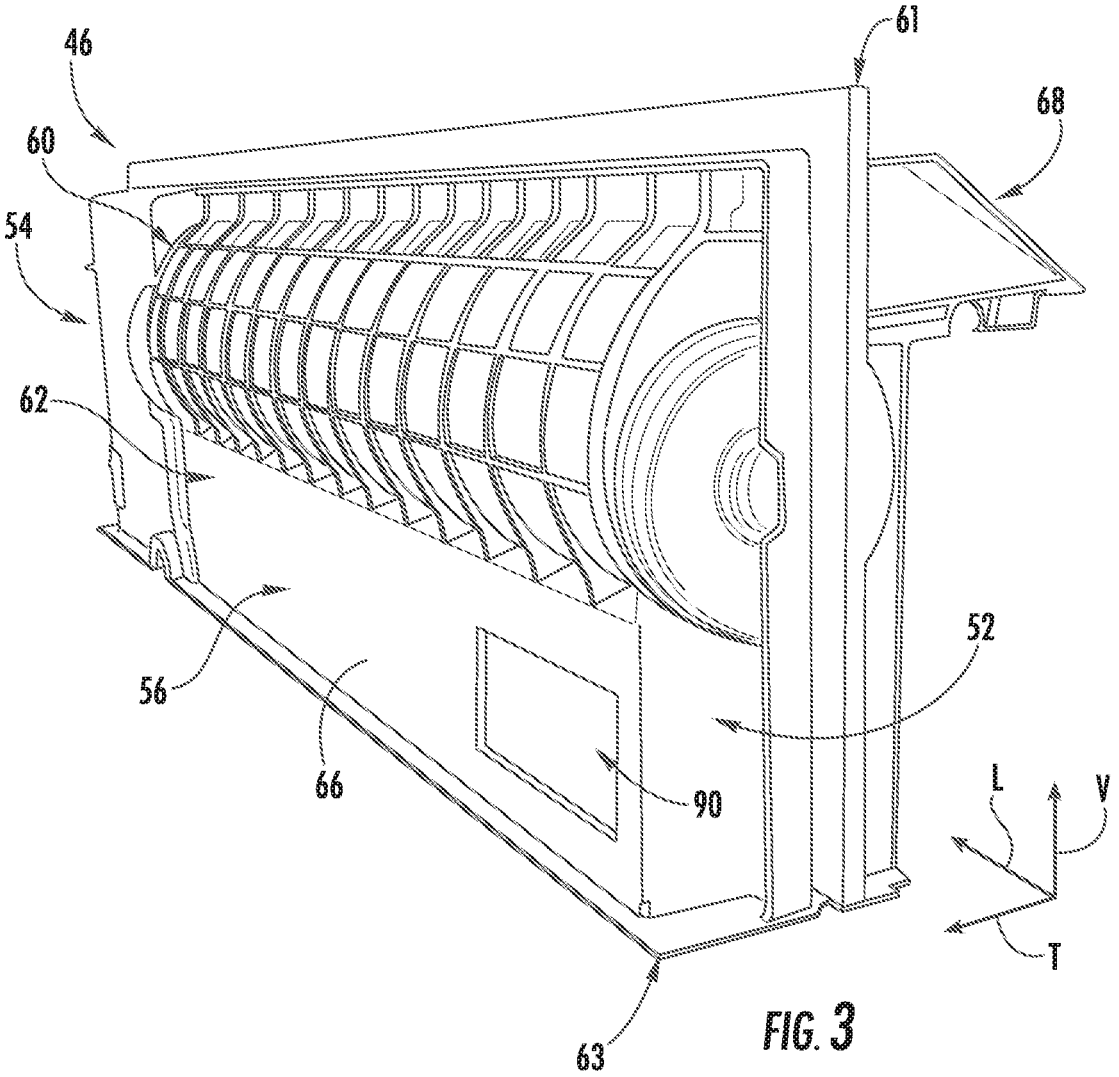
FIG. 3 is a rear perspective view of a bulkhead assembly in accordance with exemplary embodiments of the present disclosure.

Referring now also to FIG. 2, indoor portion 12 may include, for example, an indoor heat exchanger 40, a blower fan 42, and a heating unit 44. These components may, for example, be housed behind the room front 24. Additionally, a bulkhead 46 may generally support or house various other components or portions thereof of the indoor portion 12, such as the blower fan 42 and the heating unit 44. Bulkhead 46 may generally separate and define the indoor portion 12 and outdoor portion 14. As would be understood, when air conditioner 10 is mounted within a room or indoor environment (e.g., to heat or cool the room or indoor environment), indoor portion 12 is generally held or enclosed within the indoor environment. Optionally, outdoor portion 14 may be generally held outside of the indoor environment.

Outdoor and indoor heat exchangers 30, 40 may be components of a thermodynamic assembly (i.e., sealed system), which may be operated as a refrigeration assembly (and thus perform a refrigeration cycle) and, in the case of the heat pump unit embodiment, a heat pump (and thus perform a heat pump cycle). Thus, as is understood, exemplary heat pump unit embodiments may be selectively operated perform a refrigeration cycle at certain instances (e.g., while in a cooling mode) and a heat pump cycle at other instances (e.g., while in a heating mode).

Figure 5:
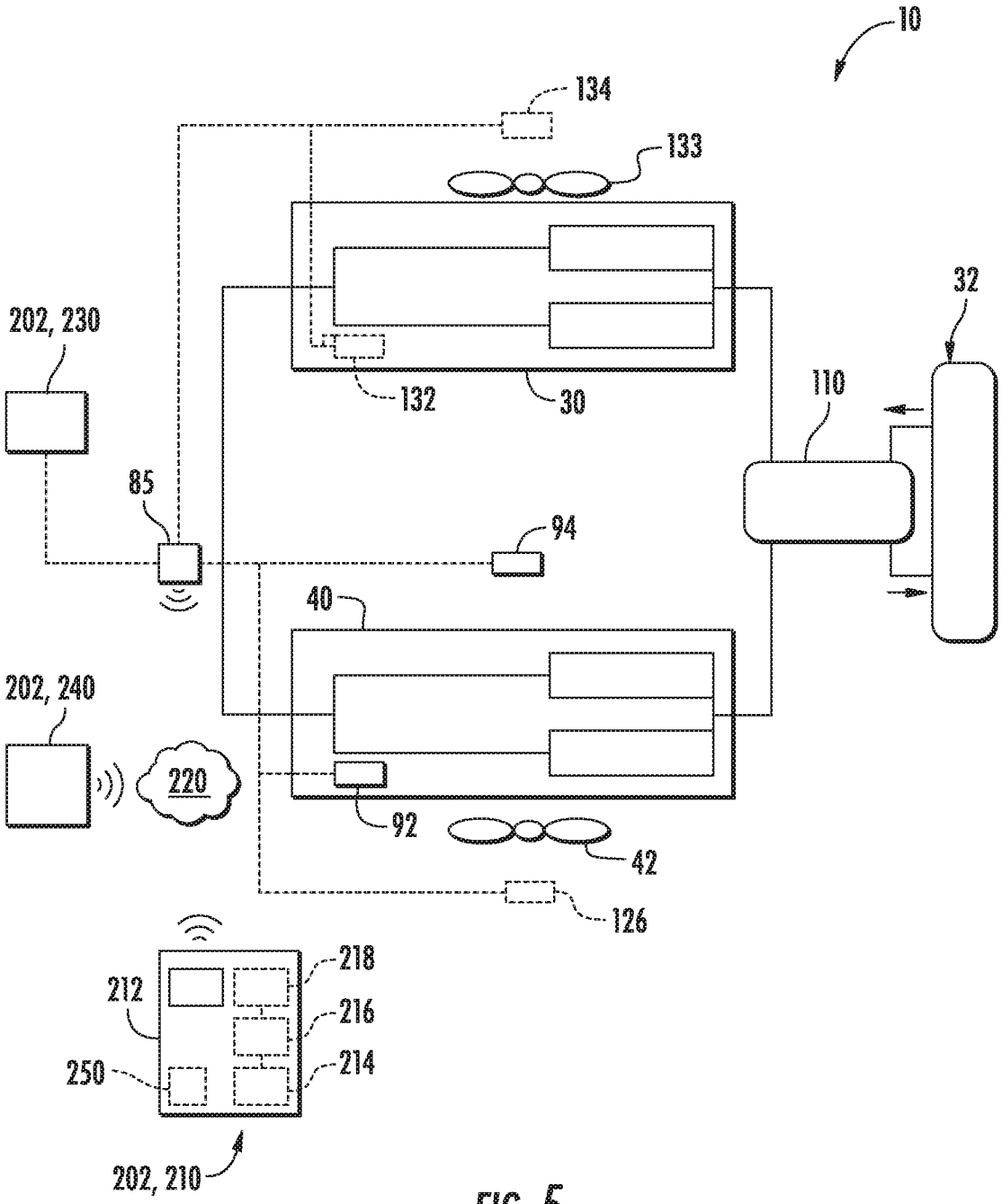
FIG. 5 provides a schematic view of an air conditioner unit according to exemplary embodiments of the present disclosure.

In optional embodiments, such as exemplary heat pump unit embodiments, the sealed system includes a reversible refrigerant valve 110 (FIG. 5). Reversible refrigerant valve 110 selectively directs compressed refrigerant from compressor 32 to either indoor heat exchanger 40 or outdoor heat exchanger 30. For example, in a cooling mode, reversible refrigerant valve 110 is arranged or configured to direct compressed refrigerant from compressor 32 to outdoor heat exchanger 30. Conversely, in a heating mode, reversible refrigerant valve 110 is arranged or configured to direct compressed refrigerant from compressor 32 to indoor heat exchanger 40. Thus, reversible refrigerant valve 110 permits the sealed system to adjust between the heating mode and the cooling mode (e.g., as selected at a control panel 87), as will be understood by those skilled in the art.

The sealed system may, for example, further include compressor 32 and an expansion valve, both of which may be in fluid communication with the heat exchangers 30, 40 to flow refrigerant therethrough, as is generally understood. Optionally, the compressor 32 may be a variable speed compressor or, alternatively, a single speed compressor. When the assembly is operating in a cooling mode, and thus performs a refrigeration cycle, the indoor heat exchanger 40 acts as an evaporator and the outdoor heat exchanger 30 acts as a condenser. In heat pump unit embodiments, when the assembly is operating in a heating mode, and thus performs a heat pump cycle, the indoor heat exchanger 40 acts as a condenser and the outdoor heat exchanger 30 acts as an evaporator. The outdoor and indoor heat exchangers 30, 40 may each include coils 31, 41, as illustrated, through which a refrigerant may flow for heat exchange purposes, as is generally understood.

Additionally or alternatively, one or more portions of heat exchangers 30, 40 may be adapted for use as dehumidification features or as part of a dehumidification routine. For instance, when a dehumidification routine is initiated or implemented (e.g., in a cooling mode or heating mode), a refrigeration cycle may be performed while air is directed across at least a portion of indoor heat exchanger 40 to generate a dry airflow, as would be understood. Certain known dehumidification routines may subsequently direct the dried airflow across a separate heating unit (e.g., as part of an active heat dehumidification routine) before the air is flowed to the room. Other known dehumidification routines may subsequently direct the dried air across a relatively hot portion of the sealed system (e.g., as part of a reheat loop dehumidification routine) before the air is flowed to the room. Still other known dehumidification routines may direct the dried air directly to the room without additional heating (e.g., as part of a cool-air dehumidification routine).

Bulkhead 46 may include various peripheral surfaces that define an interior 50 thereof. For example, and additionally referring to FIG. 3, bulkhead 46 may include a first sidewall 52 and a second sidewall 54 which are spaced apart from each other along the lateral direction L. A rear wall 56 may extend laterally between the first sidewall 52 and second sidewall 54.

The rear wall 56 may, for example, include an upper portion 60 and a lower portion 62. Upper portion 60 may for example have a generally curvilinear cross-sectional shape, and may accommodate a portion of the blower fan 42 when blower fan 42 is housed within the interior 50. Lower portion 62 may have a generally linear cross-sectional shape, and may be positioned below upper portion 60 along the vertical direction V. Rear wall 56 may further include an indoor facing surface 64 and an opposing outdoor facing surface. The indoor facing surface 64 may face the interior 50 and indoor portion 12, and the outdoor facing surface 66 may face the outdoor portion 14.

Bulkhead 46 may additionally extend between a top end 61 and a bottom end 63 along vertical axis V. Upper portion 60 may, for example, include top end 61, while lower portion 62 may, for example, include bottom end 63.

Bulkhead 46 may additionally include, for example, an air diverter 68, which may extend between the sidewalls 52, 54 along the lateral direction L and through which air may flow.

In exemplary embodiments, blower fan 42 may be a tangential fan. Alternatively, however, any suitable fan type may be used. Blower fan 42 may include a blade assembly 70 and a motor 72. The blade assembly 70, which may include one or more blades disposed within a fan housing 74, may be disposed at least partially within the interior 50 of the bulkhead 46, such as within the upper portion 60. As shown, blade assembly 70 may for example extend along the lateral direction L between the first sidewall 52 and the second sidewall 54. The motor 72 may be connected to the blade assembly 70, such as through the fan housing 74 to the blades via a shaft. Operation of the motor 72 may rotate the blades, thus generally operating the blower fan 42. Further, in exemplary embodiments, motor 72 may be disposed exterior to the bulkhead 46. Accordingly, the shaft may for example extend through one of the sidewalls 52, 54 to connect the motor 72 and blade assembly 70.

In exemplary embodiments, heating unit 44 includes one or more heater banks 80. Each heater bank 80 may be operated as desired to produce heat. In some embodiments, three heater banks 80 may be used, as shown. Alternatively, however, any suitable number of heater banks 80 may be used. Each heater bank 80 may further include at least one heater coil or coil pass 82, such as in exemplary embodiments two heater coils or coil passes 82. Alternatively, other suitable heating elements may be used. As is understood, each heater coil pass 82 may be provided as a resistive heating element configured to generate heat in response to resistance to an electrical current flowed therethrough.

The operation of air conditioner 10 including compressor 32 (and thus the sealed system generally) blower fan 42, fan 33, heating unit 44, or other suitable components may be controlled by a control board or controller 85. Controller 85 may be in communication (via for example a suitable wired or wireless connection) to such components of the air conditioner 10. By way of example, the controller 85 may include a memory and one or more processing devices such as microprocessors, CPUs or the like, such as general or special purpose microprocessors operable to execute programming instructions or micro-control code associated with operation of air conditioner 10. The memory may be a separate component from the processor or may be included onboard within the processor. The memory may represent random access memory such as DRAM, or read only memory such as ROM or FLASH. Generally, the processor executes programming instructions stored in memory.

Air conditioner 10 may additionally include a control panel 87 and one or more user inputs 89, which may be included in control panel 87. The user inputs 89 may be in communication with the controller 85. A user of the air conditioner 10 may interact with the user inputs 89 to operate the air conditioner 10, and user commands may be transmitted between the user inputs 89 and controller 85 to facilitate operation of the air conditioner 10 based on such user commands. A display 88 may additionally be provided in the control panel 87, and may be in communication with the controller 85. Display 88 may, for example be a touch-screen or other text-readable display screen, or alternatively may simply be a light that can be activated and deactivated as required to provide an indication of, for example, an event or setting for the air conditioner 10.

Figure 4:
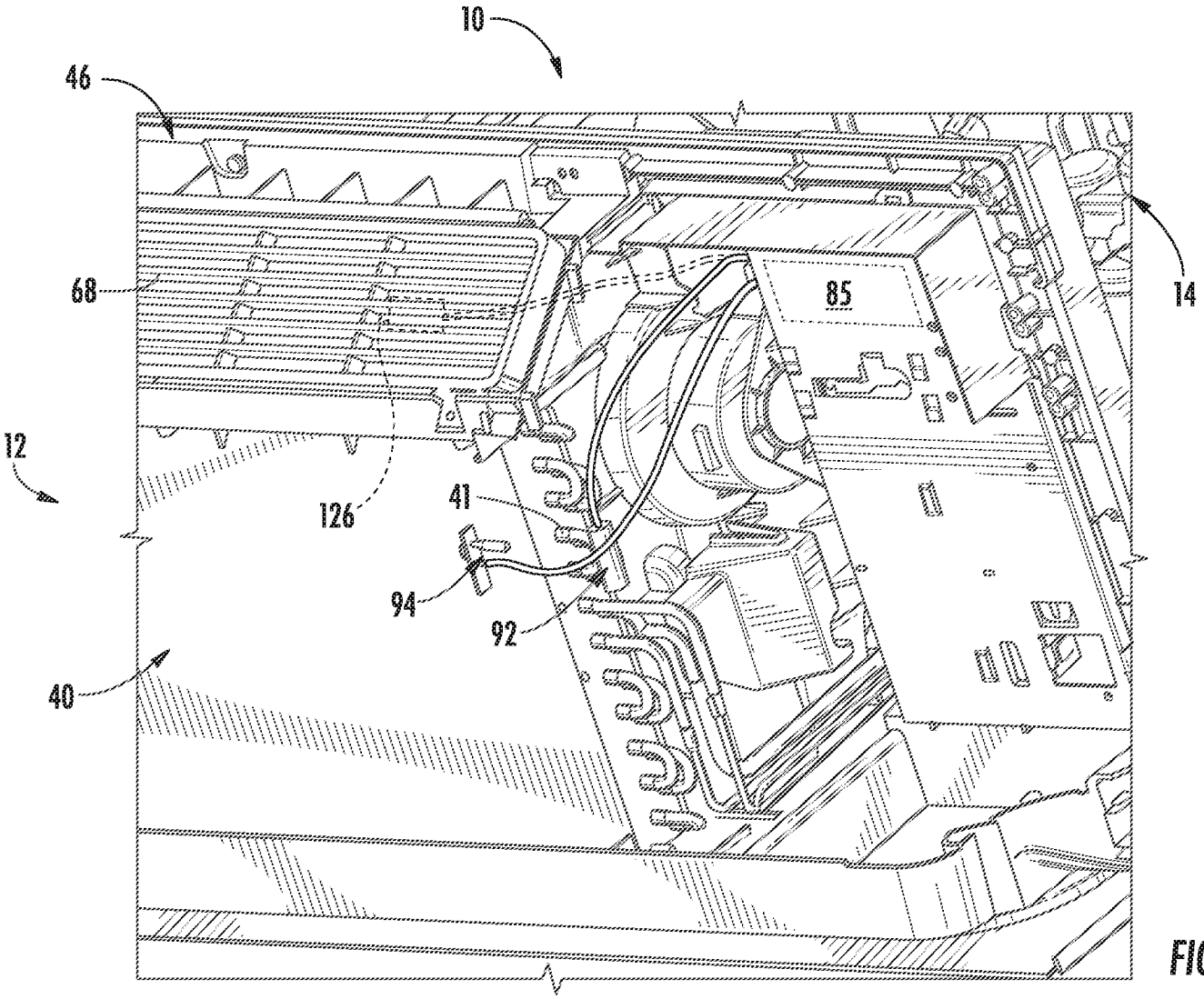
FIG. 4 is another perspective view of components of an indoor portion of an air conditioner unit in accordance with exemplary embodiments of the present disclosure.

Referring now to FIGS. 1, 4, and 5, a first indoor temperature sensor 92 (e.g., indoor refrigerant temperature sensor) and a second indoor temperature sensor 94 (e.g., indoor ambient temperature sensor) may be disposed within the indoor portion 12. In optional embodiments, a third indoor temperature sensor 126 (e.g., indoor outlet temperature sensor) (as indicated in phantom lines) is disposed within the indoor portion 12. In alternative embodiments, indoor portion 12 is free of any such third indoor temperature sensor 126. Each temperature sensor may be configured to sense the temperature of its surroundings. For example, each temperature sensor may be a thermistor or a thermocouple. The indoor temperature sensors 92, 94, 126 may be in communication with the controller 85, and may transmit temperatures sensed thereby to the controller 85 (e.g., as one or more voltages or signals, which the controller 85 is configured to interpret as temperature values). Optionally, the voltages or signal transmitted to the controller 85 may be transmitted in response to a polling request or signal received by one or more of the indoor temperature sensors 92, 94, 126. For example, a polling request or signal may be transmitted to one or more of the indoor temperature sensors 92, 94, 126 from the controller 85.

First indoor temperature sensor 92 may be disposed proximate the indoor heat exchanger 40 (such as relative to the second indoor temperature sensor 94). For example, in some embodiments, first indoor temperature sensor 92 may be in contact with the indoor heat exchanger 40, such as with a coil 41 thereof. The first indoor temperature sensor 92 may be configured to detect a temperature for the indoor heat exchanger 40. Second indoor temperature sensor 94 may be spaced from the indoor heat exchanger 40, such as in the transverse direction T. For example, the second indoor temperature sensor 94 may be in contact with the room front 24, as illustrated in FIG. 1. Second indoor temperature sensor 94 may be configured to detect a temperature of air entering the indoor portion 12. Third indoor temperature sensor 126 may be spaced apart from and disposed downstream of both the first indoor temperature sensor 92 and the second indoor temperature sensor 94. For example, the third indoor temperature sensor 126 may be attached to or in contact with the air diverter 68. The third indoor temperature sensor 126 may be configured to detect a temperature for air exiting the indoor portion 12. During certain operations (e.g., cooling operations), air may thus generally flow across or adjacent to the second indoor temperature sensor 94, the first indoor temperature sensor 92, and then the third indoor temperature sensor 126.

Referring especially to FIGS. 1 and 5, some embodiments, such as exemplary heat pump unit embodiments, a first outdoor temperature sensor 132 (e.g., outdoor refrigerant temperature sensor) (as indicated in phantom lines) and a second outdoor temperature sensor 134 (e.g., outdoor ambient temperature sensor) (as indicated in phantom lines) are disposed within the outdoor portion 14. Each temperature sensor may be configured to sense the temperature of its surroundings. For example, each temperature sensor may be a thermistor or a thermocouple. The outdoor temperature sensors 132, 134 may be in communication with the controller 85, and may transmit temperatures sensed thereby to the controller 85 (e.g., as one or more temperature signals or voltage signals, which the controller 85 is configured to interpret as temperature readings).

First outdoor temperature sensor 132 may be disposed proximate the outdoor heat exchanger 30 (such as relative to the second outdoor temperature sensor 134). For example, in some embodiments, first outdoor temperature sensor 132 may be in contact with the outdoor heat exchanger 30, such as with a coil 31 (FIG. 1) thereof. The first outdoor temperature sensor 132 may be configured to detect a temperature for the outdoor heat exchanger 30. Second outdoor temperature sensor 134 may be spaced from the outdoor heat exchanger 30, such as in the transverse direction T. For example, the second outdoor temperature sensor 134 may be in contact with the rear grill 22 (FIG. 1). The second outdoor temperature sensor 134 may be configured to detect a temperature for air entering the outdoor portion 14. During certain operations (e.g., heating operations), air may thus generally flow across or adjacent to the second outdoor temperature sensor 134 and then the first outdoor temperature sensor 132.

In some embodiments, one or more remote devices 202, such as a remote thermostat 210, utility meter 230, or remote computer 240 (e.g., personal computer, laptop, server, smartphone, tablet, etc.), is provided at a location separate and apart from the cabinet 20. For instance, the remote device 202 may be spaced apart from cabinet 20 while a corresponding remote controller of the remote device 202 is in operative communication with, and may thus exchange signals to/from, the controller 85 (e.g., via for example a suitable wired or wireless connection). Optionally, the remote device 202 may be mounted or positioned within the same room or indoor environment as the indoor and outdoor portions 12, 14. Additionally or alternatively, the remote device 202 may be independently movable relative to the cabinet 20.

In optional embodiments, a remote thermostat 210 is in operative communication with the controller 85 to selectively detecting a temperature that is not immediately adjacent to either the indoor and outdoor portions 12, 14 (e.g., within the same room or indoor environment). Thus, remote thermostat 210 includes a remote body 212 that houses or supports a suitable temperature circuit 214 for detecting temperature. For instance, the remote thermostat 210 may include a temperature circuit 214 that is or includes one or more thermocouples, thermistors, optical temperature sensors, infrared temperature sensors, etc. Within the remote body 212, a secondary controller 216 may be provided (e.g., in communication with or as part of temperature circuit 214). In additional or alternative embodiments, a network interface 218 may be mounted within the remote body 212 (e.g., to selectively communicate with the controller 85).

The secondary controller 216 may include one or more memory devices and one or more processors. The processors of the secondary controller 216 can be any combination of general or special purpose processors, CPUs, or the like that can execute programming instructions or control code associated with operation of remote thermostat 210. The memory devices (i.e., memory) of the secondary controller 216 may represent random access memory such as DRAM or read only memory such as ROM or FLASH. In certain embodiments, the processor of the secondary controller 216 executes programming instructions stored in the memory of the secondary controller 216. The memory of the secondary controller 216 may be a separate component from the processor or may be included onboard within the processor. Alternatively, the secondary controller 216 may be constructed without using a processor, for example, using a combination of discrete analog or digital logic circuitry (such as switches, amplifiers, integrators, comparators, flip-flops, AND gates, and the like) to perform control functionality instead of relying upon software.

In optional embodiments, the secondary controller 216 includes a network interface 218 (e.g., on or off board secondary controller 216) such that secondary controller 216 can connect to and communicate over one or more networks (e.g., wireless communications network 220) with the controller 85. In some such embodiments, network interface 218 includes one or more transmitting, receiving, or transceiving components for transmitting/receiving communications with the controller 85 via wireless communications network 220. In exemplary embodiments, the wireless communications network 220 may be a wireless sensor network (such as a Bluetooth communication network), a wireless local area network (WLAN), a point-to point communication networks (such as radio frequency identification networks, near field communications networks, etc.), or a combination of two or more of the above communications networks.

In certain embodiments, the secondary controller 216 is configured to transmit (e.g., wirelessly transmit) one or more detected temperature values (i.e., signals corresponding to a value of a temperature detected at remote thermostat 210) to the controller 85. For example, the secondary controller 216 may be configured to transmit detected temperature values unprompted by any outside request, such as a polling request that might otherwise be transmitted to the secondary controller 216 from the controller 85. Thus, the secondary controller 216 may determine to transmit remote temperature values independently of the controller 85 or any other device. The receipt of remote temperature values by the controller 85 may be entirely passive or unprompted by the controller 85. In some such embodiments, the remote temperature values from the secondary controller 216 are transmitted asynchronously or, alternatively, according to a predetermined transmission schedule (e.g., programmed within the secondary controller 216). Advantageously, the lack of a request-polling signal may conserve power (e.g., at the remote thermostat 210) and improve communication between the secondary controller 216 and controller 85.

Once received, a temperature value from the remote thermostat 210 (i.e., a remote temperature value) may be stored (e.g., temporarily) within controller 85, such as within a temporary or detected field. If the value meets one or more predetermined criteria, the value within the temporary or detected field may be used as an operating temperature (e.g., within an operating temperature field), which the controller 85 may treat as a measure of current temperature within a given room or indoor environment (e.g., as the controller 85 directs the sealed system in order to achieve a temperature setpoint provided by a user).

Separate from or in addition to remote thermostat 210, an occupancy reader 250 may be provided. As an example, occupancy reader 250 may be provided on or as part of a remote device 202, such as within the remote body 212 (e.g., spaced apart from cabinet 20 of unit 10). As an additional or alternative example, occupancy reader 250 may be mounted directly to or supported on cabinet 20 (e.g., at indoor portion 12). Generally, occupancy reader 250 is in operative communication with controller 85 and is configured to transmit an occupancy signal thereto. In particular, the occupancy signal transmitted by occupancy reader 250 may indicate the presence or, alternatively, absence of a person within the same room or indoor environment as unit 10. For instance, occupancy reader 250 may include an infrared motion sensor, acoustic or ultrasonic sensor, radio frequency sensor, audio sensor, touch sensor, etc. to directly detect a human body within the indoor environment. Thus, a user's directly-detected body may prompt transmission of a direct occupancy signal. Additionally or alternatively, occupancy reader 250 may indirectly detect a human body. The such as by including a keycard reader positioned within the indoor environment or on a door thereto. Thus, swiping a mated identification or access card across the occupancy reader 250 may indirectly indicate a user is present within the indoor environment and, thereby, prompt transmission of an indirect occupancy signal.

As an alternative or supplement to occupancy reader 250, one or more remote computers 240 may be in operative communication with controller 85 and be configured to selectively transmit an occupancy signal thereto. In some such embodiments, the occupancy signal is transmitted from the remote computer 240 based on a remote user input. For instance, the remote computer 240 may be provided be configured as or include a room management device, such as might be provided for a hotel system or network to manage room reservations. In response to a remote user input (e.g., indicating the room has been reserved or an intended occupant has checked in), the remote computer 240 may transmit an occupancy signal indicating the presence of a user within the room or indoor environment of the unit 10.

In additional or alternative embodiments, a utility meter 230 is in operative (e.g., wired or wireless) communication with controller 85. For instance, utility meter 230 may be an advanced utility meter that measures utility usage and provides controller 85 with a demand response signal corresponding to electric power access including, for instance, real-time utility pricing, up-to-date utility costs, energy availability, etc., as would be understood. The utility meter 230 may be in one-way or two-way communication with the utility company to transmit a demand response signal to controller 85 based on information received or determined from signals received at the utility meter 230 from the utility company. Additionally or alternatively, utility meter 230 may be in one-way or two-way communication with a local power generator (e.g., solar power generator, wind power generator, etc.) to transmit a demand response signal to controller 85 based on information received or determined from signals received at the utility meter 230 from the local power generator.

Optionally, utility meter 230 may be programmed (e.g., by a user or installer) to communicate with the utility at a specific interval or utility meter 230 may be pre-programmed to automatically communicate with the utility or local power generator within a predetermined time interval. Thus, utility meter 230 may receive information regarding energy access (e.g., pricing, costs, availability, etc.) from the utility or local power generator before transmitting a demand response signal indicating energy consumption to the controller 216. Using, or in response to the demand response signal, the controller 85 may be configured to determine a restricted power condition exists (e.g., due to relatively high pricing per kWh or limited power availability). Additionally or alternatively, controller 85 may be programmed to include a demand schedule of anticipated/planned energy consumption (e.g., pricing, costs, availability, usage, etc.). Thus, controller 85 may reference (e.g., receive an internal demand response signal) the demand schedule to determine whether (i.e., if and when) a restricted power condition exists, such as a brownout or blackout (e.g., in the case of a utility), a low-light state or a low-wind state (e.g., in the case of a local power generator), etc.

Figure 6:
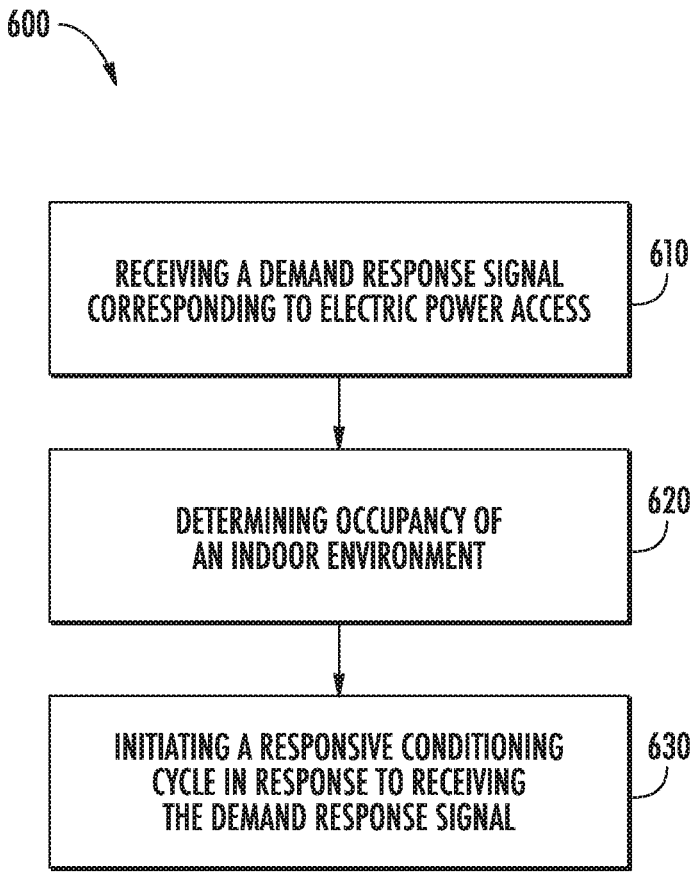
FIG. 6 provides a flow chart illustrating a method of operating an air conditioner unit according to exemplary embodiments of the present disclosure.

Referring now to FIG. 6, the present disclosure may further be directed to methods (e.g., method 600) of operating an air conditioner or air conditioning appliance, such as air conditioner 10. In exemplary embodiments, the controller 85 may be operable to perform various steps of a method in accordance with the present disclosure.

The methods (e.g., 600) may occur as, or as part of, a conditioner operation (i.e., a cooling or heating operation) of the air conditioner 10. In particular, the methods disclosed herein may advantageously tailor output or operation of the unit 10 according to real-time need (e.g., with greater specificity or variability than might be possible with existing solutions). Additionally or alternatively, the methods (e.g., 600) may advantageously ensure efficient operation of the unit 10 (e.g., in the face of high energy demands or operating costs). Except as otherwise indicated, one or more steps in the below methods (e.g., 600) may be changed, rearranged, performed in a different order, or otherwise modified without deviating from the scope of the present disclosure.

Turning especially to FIG. 6, at 610, the method 600 includes receiving a demand response signal corresponding to electric power access. In particular, the demand response signal may include data relating to utility pricing, up-to-date utility costs, or energy availability. Thus, the demand response signal may indicate, for example, the power rates (e.g., per kWh) or if/when there is a power restriction or limited power availability (e.g., during a brownout, a blackout, low-light state, low-wind state or an otherwise planned/unplanned power outage).

In some embodiments, the demand response signal is received from a remote device that is spaced apart from the cabinet of the air conditioner unit and in operative communication therewith, as described above. For instance, the demand response signal may be received from a utility meter (e.g., in communication with a utility or local power generator supplying power to the air conditioner unit or the building in which the air conditioner unit is installed).

In additional or alternative embodiments, the demand response signal is transmitted and received internally within the air conditioner unit. Specifically, the demand response signal may be received from another portion of the controller of the air conditioner unit. For instance, the controller may include a programmed demand schedule of anticipated/planned energy consumption (e.g., pricing, costs, availability, usage, etc.). In some such embodiments, the programmed demand schedule indicates at what time of the day/month/year certain power rates or restrictions are planned (e.g., by the utility or local power generator supplying power to the air conditioner unit or the building in which the air conditioner unit is installed).

At 620, the method 600 includes determining occupancy of the indoor environment in which the air conditioner unit is mounted. Occupancy may be determined, for instance, based on a received occupancy signal including information or data from which the current/anticipated presence of one or more human users can be detected. The occupancy signal may include a voltage signal from a sensor which detects a characteristic or condition that has previously been found to indicate a human presence or count (e.g., within the room or indoor environment in which the air conditioner unit is installed). Additionally or alternatively, the occupancy signal may include a data packet of user presence (e.g., a binary "present/absent" value or, alternatively, a particular number of users) calculated apart from the air conditioner unit.

In some embodiments, 620 includes receiving a direct occupancy signal from an external sensor spaced apart from the cabinet of the air conditioner unit (e.g., from an external thermostat or remote occupancy reader), as described above. In additional or alternative embodiments, 620 includes receiving an indirect occupancy signal from a remote device spaced apart from the cabinet of the air conditioner unit (e.g., from a remote computer or occupancy reader), as also described above. In further additional or alternative embodiments, 620 includes receiving an occupancy signal (e.g., direct occupancy signal or indirect occupancy signal) from a supported occupancy reader attached to the cabinet of the single-package air conditioner unit, as further described above.

At 630, the method 600 includes initiating a responsive conditioning cycle in response to receiving the demand response signal. Moreover, the responsive conditioning cycle may be based on the determined occupancy. The responsive conditioning cycle may generally depart from typical or unrestrained cycles of the unit, such as by limiting the use of certain features. Optionally, the responsive conditioning cycle may set a temporary power use limit (e.g., for the duration of the responsive conditioning cycle) that is less than the maximum power use of the unit.

As an example, the responsive condition cycle may relate to compressor speed of the compressor. In some such embodiments, 630 includes adjusting a compressor speed (e.g., permitted maximum compressor speed at which the compressor can operate). Optionally, the adjusted compressor speed may be a permitted maximum compressor speed (e.g., set as a percentage of possible compressor speeds between 0% and 100%) at which the compressor can operate during the responsive conditioning cycle. For instance, 630 may reduce the maximum compressor speed from a high-power maximum compressor speed (e.g., set at a value between 75% to 100% for a typical cycle) to one or more predetermined low-power maximum compressor speeds (e.g., set at a value between 1% and 75%). In certain embodiments, the predetermined low-power compressor speed is less than 50%.

In additional or alternative embodiments, a plurality of discrete predetermined low-power maximum compressor speeds are provided (e.g., within the controller). Optionally, three or more (e.g., four) low-power maximum speeds may be provided, such as a first low-power speed (e.g., 50%), a second low-power speed (e.g., 35%), a third low-power speed (e.g., 20%), or a fourth low-power speed (e.g., 10%). In some such embodiments, one of the plurality of discrete predetermined low-power maximum speeds may be selected or adopted based on the determined occupancy. For instance, if the occupancy is determined to be low (e.g., the indoor environment is determined to be unoccupied), the lowest predetermined low-power maximum speed may be selected. By contrast, if the occupancy is determined to be high (e.g., the indoor environment is determined to be occupied), one of the relatively-high predetermined low-power maximum speeds may be selected. One of the relatively-high predetermined low-power max speeds may be selected, for example, based on a user input signal (e.g., indicating a desired temperature within the indoor environment). Additionally or alternatively, of the relatively-high predetermined low-power max speeds may be selected based on one or more conditions detected at the unit (e.g., indoor temperature, outdoor temperature, etc.). Thus, power use of the unit may be advantageously varied while providing responsive performance in the presence of a user.

As an additional or alternative example, the responsive condition cycle may relate to dehumidification performance or features of the unit. In some such embodiments, 630 includes restricting dehumidification of the single-package air conditioner unit. For instance, the unit may be prevented to initiating one or more dehumidification routines. Optionally, a plurality of discrete dehumidification routines are provided, such as an active heat dehumidification routine, a reheat loop dehumidification routine, or a cool air dehumidification routine. In some such embodiments, one or more of the plurality of discrete dehumidification routines may be initiated or restricted based on the determined occupancy. For instance, if the occupancy is determined to be low (e.g., the indoor environment is determined to be unoccupied), the least power-demanding dehumidification routine may be initiated or, alternatively, all dehumidification routines may be prevented. By contrast, if the occupancy is determined to be high (e.g., the indoor environment is determined to be occupied), one of the relatively undemanding dehumidification routines (e.g., the reheat or cool air dehumidification routine) may be initiated. One of the relatively undemanding dehumidification routines may be initiated, for example, based on a user input signal (e.g., indicating dehumidification is generally desired). Thus, power use of the unit may be advantageously varied while providing responsive performance in the presence of a user.

As another additional or alternative example, the responsive condition cycle may relate to a selected mode of the unit (e.g., as selected by a user input at the control panel). Thus, the responsive conditioning cycle may further vary based on the mode in which the unit is in at a given moment. Moreover, a predetermined setting may be adopted when the indoor environment is unoccupied (i.e., based on the determined occupancy being unoccupied). Specifically, the operating temperature or setpoint for the unit may be adjusted. For instance, when the determined occupancy is unoccupied while the unit is in a cooling mode, the responsive conditioning cycle may include automatically (e.g., without requiring further direct user input) raising the operational temperature setting to a predetermined maximum temperature setting (e.g., greater than or equal to 85° Fahrenheit) according to the cooling mode. By contrast, when the determined occupancy is unoccupied while the unit is in a heating mode, the responsive conditioning cycle may include automatically (e.g., without requiring further direct user input) lowering the operational temperature setting to a predetermined minimum temperature setting (e.g., less than or equal to 60° Fahrenheit) according to the heating mode. Optionally, subsequent determinations that the indoor environment is occupied may prompt the controller to return the operational setpoint to a previous or default temperature setting (e.g., between 65° Fahrenheit and 75° Fahrenheit).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a single-package air conditioner unit mounted within an indoor environment, the method comprising:

receiving a demand response signal corresponding to electric power access;

determining occupancy of the indoor environment as a binary value as to whether the indoor environment is or is to be occupied; and initiating a responsive conditioning cycle in response to receiving the demand response signal, the responsive conditioning cycle being based on the determined occupancy, wherein the single-package air conditioner unit is programmed with a plurality of dehumidification routines of varying demand levels during an active refrigeration or heat pump cycle, wherein initiating the responsive conditioning cycle comprises preventing one or more of the plurality of dehumidification routines based on the determined occupancy as the binary value as to whether the indoor environment is or is to be occupied, wherein the plurality of dehumidification routines of varying demand levels comprises an active heat dehumidification routine and a reheat loop or cool air dehumidification routine, and wherein preventing one or more of the plurality of dehumidification routines comprises preventing the active heat dehumidification routine while permitting the reheat loop or cool air dehumidification routine.

2. The method of claim 1, wherein the demand response signal is received from a remote device spaced apart from a cabinet of the single-package air conditioner unit and in operative communication therewith.

3. The method of claim 1, wherein the demand response signal is received from a controller including a programmed demand schedule within the single-package air conditioner unit.

4. The method of claim 1, wherein determining occupancy comprises receiving a direct occupancy signal from an external sensor spaced apart from a cabinet of the single-package air conditioner unit and in operative communication therewith.

5. The method of claim 1, wherein determining occupancy comprises receiving an indirect occupancy signal from a remote device spaced apart from a cabinet of the single-package air conditioner unit and in operative communication therewith.

6. The method of claim 1, wherein determining occupancy comprises receiving an occupancy signal from a supported occupancy reader attached to a cabinet of the single-package air conditioner unit.

7. The method of claim 1, wherein initiating the responsive conditioning cycle comprises adjusting a compressor speed of a compressor of the single-package air conditioner unit.

8. The method of claim 1, wherein determining occupancy comprises determining a low occupancy, and wherein initiating the responsive conditioning cycle further comprises initiating a least power-demanding routine of the plurality of dehumidification routines.

9. The method of claim 1, wherein the determined occupancy is unoccupied, wherein the single-package air conditioner unit is in a cooling mode, and wherein initiating a responsive conditioning cycle comprises automatically raising an operational temperature setting to a predetermined maximum temperature setting according to the cooling mode.

10. The method of claim 1, wherein the determined occupancy is unoccupied, wherein the single-package air conditioner unit is in a heating mode, and wherein initiating a responsive conditioning cycle comprises automatically lowering an operational temperature setting to a predetermined minimum temperature setting according to the heating mode.

11. A single-package air conditioner unit comprising:

a cabinet defining an outdoor portion and an indoor portion;

an outdoor heat exchanger disposed in the outdoor portion;

an indoor heat exchanger disposed in the indoor portion;

a compressor in fluid communication with the outdoor heat exchanger and the indoor heat exchanger to circulate a refrigerant between the outdoor heat exchanger and the indoor heat exchanger; and a controller in operative communication with the compressor, the controller being configured to initiate a conditioning operation, the conditioning operation comprising receiving a demand response signal corresponding to electric power access, determining occupancy of an indoor environment as a binary value as to whether the indoor environment is or is to be occupied, and initiating a responsive conditioning cycle in response to receiving the demand response signal, the responsive conditioning cycle being based on the determined occupancy, wherein the controller is programmed with a plurality of dehumidification routines of varying demand levels during an active refrigeration or heat pump cycle to circulate refrigerant through the compressor, wherein initiating the responsive conditioning cycle comprises preventing one or more of the plurality of dehumidification routines based on the determined occupancy as the binary value as to whether the indoor environment is or is to be occupied, wherein the plurality of dehumidification routines of varying demand levels comprises an active heat dehumidification routine and a reheat loop or cool air dehumidification routine, and wherein preventing one or more of the plurality of dehumidification routines comprises preventing the active heat dehumidification routine while permitting the reheat loop or cool air dehumidification routine.

12. The single-package air conditioner unit of claim 11, wherein the demand response signal is received from a remote device spaced apart from the cabinet.

13. The single-package air conditioner unit of claim 11, wherein the controller includes a programmed demand schedule for the demand response signal.

14. The single-package air conditioner unit of claim 11, wherein determining occupancy comprises receiving a direct occupancy signal from an external sensor spaced apart from the cabinet.

15. The single-package air conditioner unit of claim 11, wherein determining occupancy comprises receiving an indirect occupancy signal from a remote device spaced apart from the cabinet.

16. The single-package air conditioner unit of claim 11, further comprising a supported occupancy reader attached to the cabinet in operative communication with the controller, wherein determining occupancy comprises receiving an occupancy signal from the supported occupancy reader.

17. The single-package air conditioner unit of claim 11, wherein initiating the responsive conditioning cycle comprises adjusting a compressor speed of the compressor.

18. The single-package air conditioner unit of claim 11, wherein the determined occupancy is unoccupied, wherein the single-package air conditioner unit is in a cooling mode, and wherein initiating a responsive conditioning cycle comprises automatically raising an operational temperature setting to a predetermined maximum temperature setting according to the cooling mode.

19. The single-package air conditioner unit of claim 11, wherein the determined occupancy is unoccupied, wherein the single-package air conditioner unit is in a heating mode, and wherein initiating a responsive conditioning cycle comprises automatically lowering an operational temperature setting to a predetermined minimum temperature setting according to the heating mode.

20. The single-package air conditioner unit of claim 11, wherein determining occupancy comprises determining a low occupancy, and wherein initiating the responsive conditioning cycle further comprises initiating a least power-demanding routine of the plurality of dehumidification routines.

* * * * *